US011958646B2

(12) United States Patent
Lelie

(10) Patent No.: US 11,958,646 B2
(45) Date of Patent: Apr. 16, 2024

(54) SHRINK TUNNEL FOR SHRINKING SHRINK FILMS ONTO PACKAGES, SUCH AS BOXES, BOTTLES, CANS, OR SIMILAR CONTAINERS, OR PACKAGING UNITS, AND A METHOD OF OPERATING A SHRINK TUNNEL TO SHRINK WRAP PACKAGES OR PACKAGING UNITS

(75) Inventor: Thomas Lelie, Kleve (DE)

(73) Assignee: KHS GmbH, Dortmund (DE)

( * ) Notice: Subject to any disclaimer, the term of this patent is extended or adjusted under 35 U.S.C. 154(b) by 912 days.

(21) Appl. No.: 12/570,900

(22) Filed: Sep. 30, 2009

(65) Prior Publication Data

US 2010/0077702 A1 Apr. 1, 2010

Related U.S. Application Data

(63) Continuation-in-part of application No. PCT/EP2007/003987, filed on May 7, 2007.

(30) Foreign Application Priority Data

Mar. 30, 2007 (DE) ..... 10 2007 015 753 .5

(51) Int. Cl.

| | |
|---|---|
| ***B65B 53/00*** | (2006.01) |
| ***B65B 53/06*** | (2006.01) |
| ***F23C 99/00*** | (2006.01) |
| ***F23D 14/16*** | (2006.01) |

(52) U.S. Cl.

CPC ..... *B65B 53/063* (2013.01); *F23C 99/006* (2013.01); *F23D 14/16* (2013.01)

(58) Field of Classification Search

CPC ..... B65B 53/063; B65B 53/06; B65B 53/02; F23D 14/16; F23C 99/006

USPC ..... 53/442, 557; 431/354, 328; 34/224

See application file for complete search history.

(56) References Cited

U.S. PATENT DOCUMENTS

| | | | | |
|---|---|---|---|---|
| 3,309,835 A | | 3/1967 | Peppler | |
| 3,357,153 A | * | 12/1967 | Shaffer | 53/442 |
| 3,605,283 A | * | 9/1971 | Zelnick et al. | 34/224 |
| 3,713,401 A | * | 1/1973 | McClurkin | 432/64 |
| 3,717,939 A | | 2/1973 | Mitchell | |

(Continued)

FOREIGN PATENT DOCUMENTS

| | | |
|---|---|---|
| DE | 20 15 893 A | 10/1970 |
| DE | 22 16 822 A | 10/1972 |

(Continued)

OTHER PUBLICATIONS

International Search Report PCT/EP2007/003987 and English translation thereof, dated Nov. 27, 2007.

(Continued)

*Primary Examiner* — Andrew M Tecco

(74) *Attorney, Agent, or Firm* — Laurence A. Greenberg; Werner H. Stemer; Ralph E. Locher

(57) ABSTRACT

A shrink-wrapping tunnel heater which comprises a gas heater which heats gas used to heat and shrink a shrink film onto articles, such as packages or packaging units. The heater has at least one porous burner which comprises a porous body or reactor. The porous body or reactor designed to combust fuel therein to produce heat, but without an open flame. Articles are moved through the shrink tunnel and the heated gas heats and shrinks shrinkwrap film onto the articles.

8 Claims, 2 Drawing Sheets

(56) References Cited

U.S. PATENT DOCUMENTS

| | | | | | |
|---|---|---|---|---|---|
| 3,744,146 | A | | 7/1973 | Nichols | |
| 3,777,446 | A | * | 12/1973 | Graver | B29C 35/04 219/400 |
| 3,897,671 | A | * | 8/1975 | Higgins | 53/442 |
| 3,930,790 | A | | 1/1976 | Rogosch | |
| 4,640,726 | A | * | 2/1987 | Sallee et al. | 156/85 |
| 4,643,667 | A | * | 2/1987 | Fleming | 431/7 |
| 4,719,332 | A | * | 1/1988 | Markuson, Jr. | B29C 61/00 219/388 |
| 4,746,287 | A | * | 5/1988 | Lannutti | 431/328 |
| 4,877,012 | A | * | 10/1989 | Hannen et al. | 126/99 R |
| 5,062,217 | A | | 11/1991 | Tolson | |
| 5,431,557 | A | * | 7/1995 | Hamos | 431/7 |
| 5,645,043 | A | * | 7/1997 | Long et al. | 129/92 AC |
| 6,257,868 | B1 | * | 7/2001 | Durst et al. | 431/7 |
| 7,703,263 | B2 | * | 4/2010 | Reiner | 53/442 |
| 2003/0044744 | A1 | * | 3/2003 | Nava | B65B 53/063 432/143 |

FOREIGN PATENT DOCUMENTS

| | | | |
|---|---|---|---|
| DE | 4322109 | A1 | 1/1995 |
| DE | 196 46 957 | A1 | 5/1998 |
| DE | 19962414 | A1 | 6/2000 |
| DE | 10160837 | | 7/2003 |
| DE | 102004049903 | | 4/2006 |
| DE | 102005004062 | A1 | 7/2006 |
| DE | 102005057238 | | 5/2007 |
| EP | 1 247 745 | A | 10/2002 |
| EP | 1918640 | A2 | 5/2008 |
| JP | 62112910 | A | 5/1987 |
| JP | 551708 | U | 7/1993 |
| JP | 7112719 | A | 5/1995 |
| JP | 2009073260 | | 4/2009 |
| WO | WO 02/36436 | A1 | 5/2002 |

OTHER PUBLICATIONS

German Search Report 10 2007 015 753.5-27, Date as best understood by Examiner dated Jul. 11, 2007.

* cited by examiner

SHRINK TUNNEL FOR SHRINKING SHRINK FILMS ONTO PACKAGES, SUCH AS BOXES, BOTTLES, CANS, OR SIMILAR CONTAINERS, OR PACKAGING UNITS, AND A METHOD OF OPERATING A SHRINK TUNNEL TO SHRINK WRAP PACKAGES OR PACKAGING UNITS

CONTINUING APPLICATION DATA

This application is a Continuation-In-Part application of International Patent Application No. PCT/EP2007/003987, filed on May 7, 2007, which claims priority from Federal Republic of Germany Patent Application No. 10 2007 015 753.5, filed on Mar. 30, 2007. International Patent Application No. PCT/EP2007/003987 was pending as of the filing date of this application. The United States was an elected state in International Patent Application No. PCT/EP2007/003987.

BACKGROUND

1. Technical Field

The present application relates to a shrink tunnel for shrinking a shrink film onto packages or packaging units using a hot shrink gas, said shrink tunnel having a shrink gas heater that includes at least one burner for generating the hot shrink gas.

2. Background Information

Background information is for informational purposes only and does not necessarily admit that subsequently mentioned information and publications are prior art.

Shrink tunnels for shrinking shrink films onto products, e.g. onto packaging units, for instance to form groups from a plurality of individual packages or packaging units, are known. The shrinking is effected in this case by means of a hot air flow or hot gas flow, which is referred to below as shrink gas flow and is applied, for instance, from the side onto the respective packaging unit that has already been wrapped in the shrink film so as to shrink the shrink film onto the packaging unit. In addition, the shrink gas flow is also directed onto the underside of the product wrapped with the shrink film in order to seal, i.e. to fuse or stick together the overlapping ends of the shrink film at that location.

The shrink gas flow is made available by a hot gas heater or shrink gas heater, which has at least one heating device that is operated, for instance, in an electrical manner or with a gaseous or liquid fuel. In the latter case, the hot gas heater has a burner, which is designed for open-flame combustion of the gaseous or liquid fuel and impacts upon an interior space of a combustion chamber that is separated from the shrink gas flow and outputs thermal energy to the shrink gas flow in the manner of a heat exchanger.

Also known are so-called porous burners, for instance in the form of gas burners where flameless, volumetric combustion (glowing foam) is carried out in at least one reactor, which comprises one or more porous bodies.

OBJECT OR OBJECTS

One object of the present application is to provide a shrink tunnel or a hot gas or shrink gas heater for such a shrink tunnel, with improved efficiency.

SUMMARY

A shrink tunnel for shrinking a shrink film onto packages or packaging units using a hot shrink gas, said shrink tunnel having a shrink gas heater that includes at least one burner for generating the hot shrink gas, wherein the at least one burner is a porous burner is realized to achieve this object. Another object of the present application may be a shrink gas heater for use with a shrink tunnel for shrinking a shrink film onto packages or packaging units using a hot shrink gas. The shrink gas heater includes at least one burner. At least one burner is a porous burner.

In the case of one possible embodiment of the present application, the at least one burner, designed as a porous burner, operates directly in the shrink gas flow used to shrink the shrink film, thereby producing a possibly high level of efficiency, a reduction in heating-up time and a considerable reduction in energy costs compared to electrically operated hot gas heaters.

As in the case of the embodiment of the at least one burner as a porous burner, the fuel is combusted with no open flame in a homogeneous, stable volumetric combustion process (glowing foam) within the porous body, and consequently there is no danger of an open flame blowing out, in accordance with one realization of the porous burner underlying the present application, the burner can impact directly on the hot gas flow or can be positioned relative to said hot gas flow, in one possible embodiment also avoiding the danger of an explosion within the shrink tunnel caused by non-combusted fuel.

In at least one possible embodiment, the burner or its combustion space formed by the pore body or reactor is arranged directly in the flow of shrink gas, for example, cold air, or acts directly on it, yet with a substantially safe method of operation with minimized or virtually no danger of explosion. Such safety in operation is due to the fact that the combustion space formed in the pore body or reactor, in which the burning of the fuel and air mix occurs in a conventional manner, such as, for example, using an ignition device, and the combustion process occurring therein, are both shielded off from the flow of shrink gas. Such shielding minimizes or essentially prevents the flow of shrink gas from preventing the combustion from occurring. In contrast, a heating device in which combustion occurs in the flow of shrink gas without any type of shielding runs the risk of a "blow-out" or extinguishing or prevention of the combustion process by the flow of shrink gas. Such a "blow-out" could result in uncombusted, explosive, combustible gas flowing directly into the shrink tunnel. Thus, a heater which acts directly on the flow of shrink gas or is situated in it so that the hot combustion gases of the heater get directly into the flow of shrink gas, but at the same time shields the combustion process from the flow of shrink gas, produces the benefits of a reduction of the heat-up time of the shrink tunnel and a substantial lowering of the energy costs, essentially without the need for an expensive monitoring of the combustion process to watch for dangerous build-up of uncombusted, combustible gas in the shrink tunnel. For this purpose, a pore burner may be utilized since the combustion space of such a burner, formed by the pore body or reactor, is also protected by the pore body against an extinguishing of the combustion process by the shrink gas flow when such a burner is arranged in the shrink gas flow.

In at least one embodiment, the at least one pore burner with its pore body or reactor is arranged in a heating space, along with a heating coffer or cartridge somewhat spaced apart from it, through which the shrink gas can flow. In such an embodiment the hot combustion gases of the pore burner fed directly to the heating space are not only mixed in with the shrink gas, but also heat the heating coffer or cartridge at the same time. As a result, the heating coffer or cartridge can then heat the shrink gas flowing through the heating coffer, thereby achieving substantially uniform heating of the shrink gas flowing through the heating space.

A gaseous fuel, for example natural gas or liquid gas, for example propane gas, is used as fuel. In principle, many fuels comprising hydrocarbons can be used, in one possible embodiment also liquid fuels, such as heating oils. Where heating oils are used, the porous burner additionally has an evaporation chamber, to which the liquid fuel and oxygen or respectively air are supplied. Further developments of the present application are an object of the present application. The present application is described in more detail below by way of the figures of one possible embodiment.

The present application also includes a method where a shrink tunnel and/or a shrink gas heater is used in one of the possible embodiments described in the description and according to the present application.

The above-discussed embodiments of the present invention will be described further herein below. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

DESCRIPTION OF EMBODIMENT OR EMBODIMENTS

Figure 1:
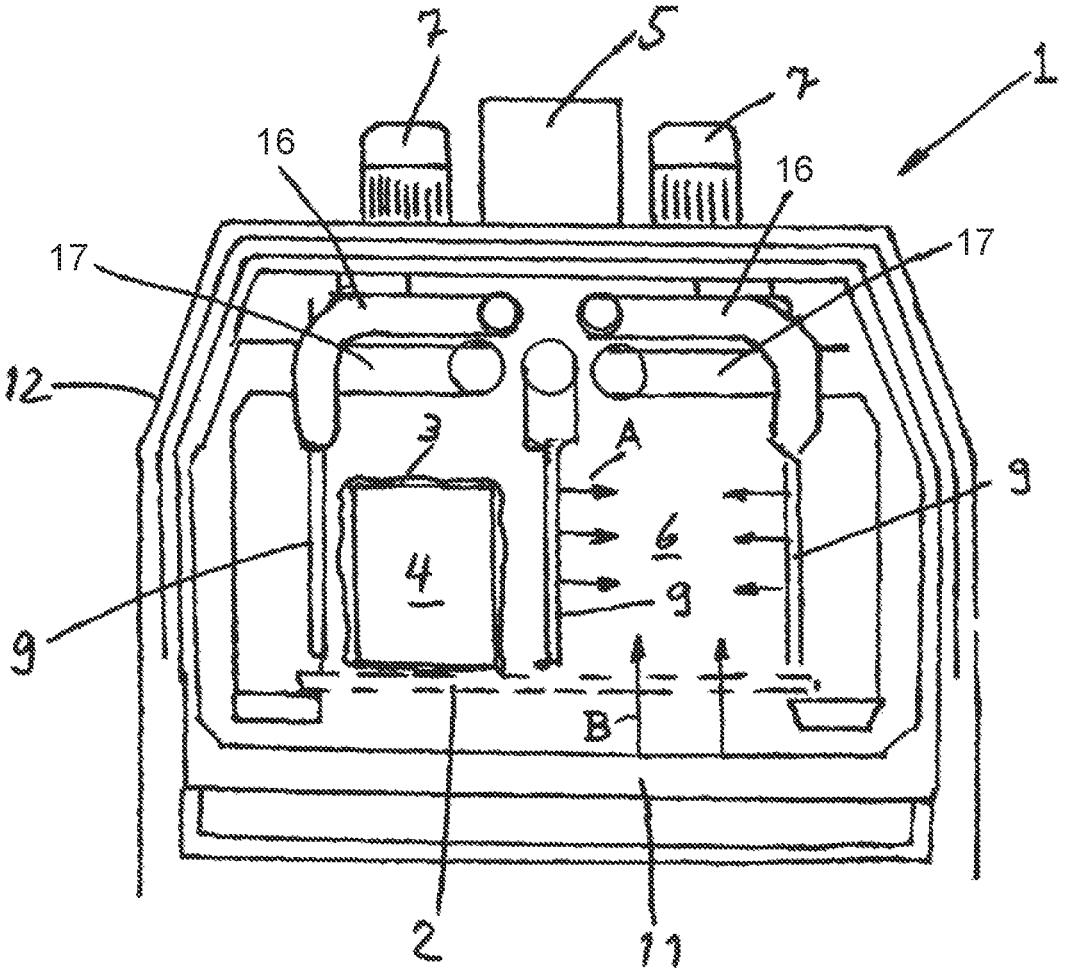
FIG. 1 shows a simplified representation and section of a shrink tunnel according to the present application.

In the figures the reference 1 is given to a shrink tunnel, through which packaging units 4, already wrapped with a shrink film 3, are moved on a conveyor 2 in a horizontal direction of transport perpendicular or substantially perpendicular to the drawing plane of FIG. 1 and in which the shrinking of the shrink film 3 onto the packaging units 4 and also the sealing, i.e. the fusing and/or sticking together of the overlapping ends of the shrink film 3 situated on the underside of the packaging units 4 is carried out by using the effect of heat (from the side and from below), so that each packaging unit 4 leaves the shrink tunnel 1 with the shrunk-on shrink film 3.

The packaging units 4, in this case, are for instance containers or other individual packages that, assembled together to form a packaging unit or group unit, are combined together by the shrunk-on shrink foil 3 to form a group. In the case of the specific embodiment represented, the conveyor 2 is designed for a two-track flow of packaging units 4.

The shrinking of the shrink film 3 and the sealing of the ends of the film on the underside of each packaging unit 4 is effected with hot shrink gas, which, generated in a shrink gas heater 5, is output into the interior space 3 via blowers 8, driven by electric motors 7, and a plurality of air outlet openings, each provided on distributor channels 9, in such a manner that the hot shrink gas impacts in each case substantially from the side as "top air" onto the packaging units 4 moving past, as is indicated by the arrows A.

The shrink gas heater also prepares the so-called "bottom air", which, via blowers 10 driven by the electric motors 7 and a distributor channel positioned underneath the conveyor 2 or via air outlet openings provided at that location, impacts onto the underside of the packaging units 4 wrapped with the shrink film 3 for sealing the overlapping ends of the shrink film, as is indicated by the arrows B.

Figure 2:
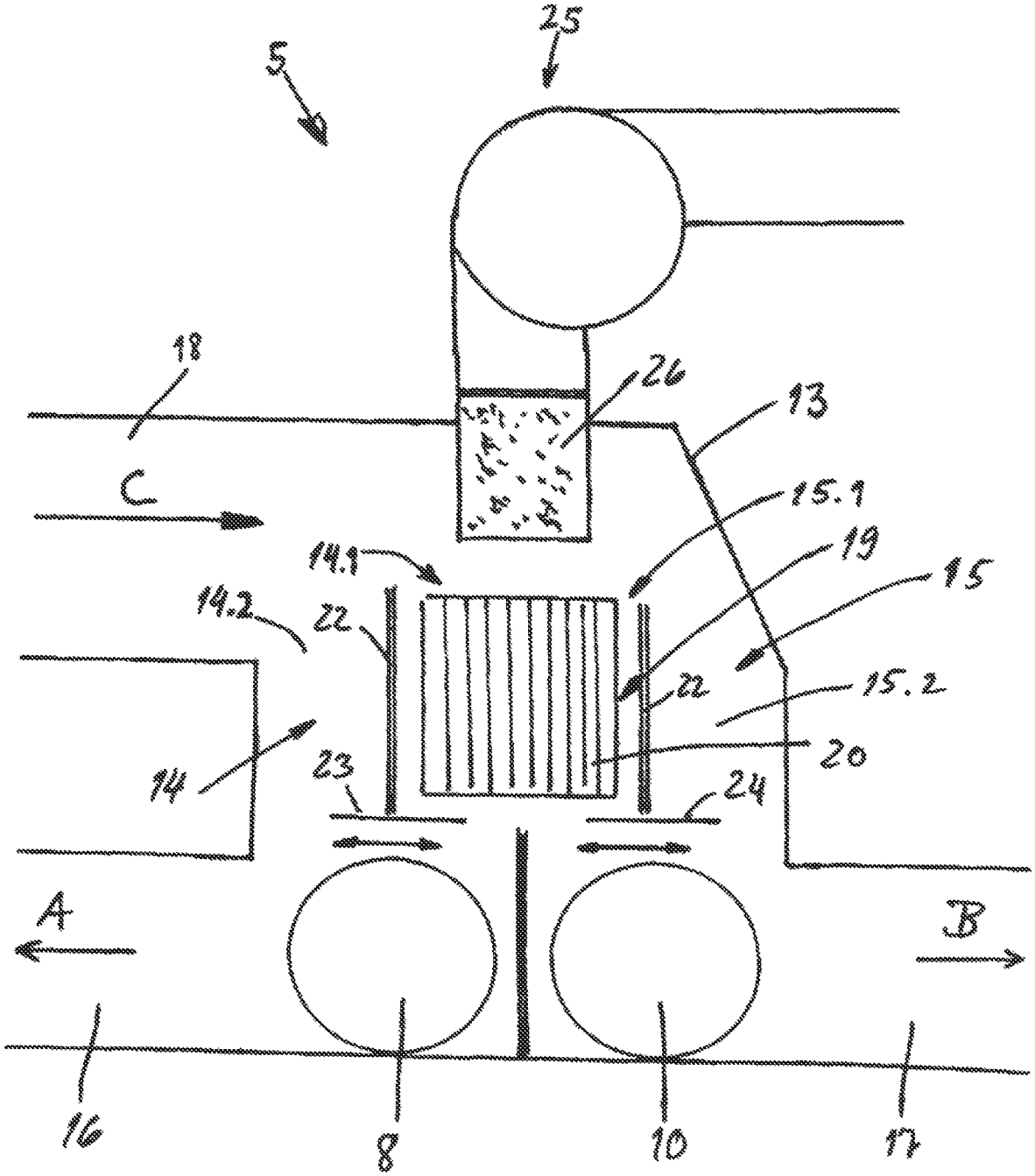
FIG. 2 shows a simplified schematic representation of the air heater or shrink gas heater of the shrink tunnel in FIG. 1 for preparing the hot shrink gas (hot air) for shrinking the shrink film and for sealing the overlapping ends of the shrink film.

The characteristic of the present application is in the shrink gas heater 5 provided on the top side of a shrink tunnel housing 12. One possible embodiment of the shrink gas heater 5 is represented in a general manner in FIG. 2. In the case of this embodiment, two flow channels or flow paths are formed in a housing 13, a flow path 14 for the top air and a flow path 15 for the bottom air. The blowers 8 or respectively 10 are provided in each flow path 14 or respectively 15 at the outlet 16 (flow path 14) or respectively at the outlet 17 (flow path 15), for reasons of simplicity one blower being shown in FIG. 2 in each case for the top air and the bottom air. Both flow channels 14 or 15 have a common inlet 18 for sucking in the air from the interior space 6 of the shrink tunnel 1 (arrows C in FIGS. 1 and 2).

In the interior of the housing 13 a heating space 19 is formed in which, among other things, a heating cartridge 20 of a heating register or of a heater 5 is positioned. Two branches or sections are formed for each flow path 14 or 15 by partition walls 22 that define the heating space 19 at the sides, that is for the flow path 14, the portion 14.1 that leads through the heating space 19 and the bypass or section 14.2 that passes said section 14.1 at the side of the heating space 19, and for the flow path 15, in an analogous manner the section 15.1 that leads through the heating space 19 and the bypass or section 15.2 that passes to the side of the heating space. In the direction of flow downstream of the heating space 19, the two sections of each flow path 14 or 15 are once again brought together via controllable air guides 23 or 24 for controlling the mixing ratio of the amount of shrink gas flowing through the heating space 19 and the amount of shrink gas passing the heating space, i.e. for temperature control. The heating cartridge 20, in the specific embodiment represented, comprises a plurality of plates or ribs positioned parallel or substantially parallel to one another and spaced apart from one another, said plates or ribs in each case being oriented with their surface sides parallel or substantially parallel to the direction of flow of the air flowing through the heating space 19 or the heating cartridge 20.

The core of the heater 5 is a porous burner 25, which operates in a flameless manner using gas, is provided on the top side of the heating cartridge 20 at a small spacing from said cartridge and impacts directly into the heating space 19, i.e. its hot combustion gases are supplied directly to the heating space 19, there they heat the heating cartridge 20 and are mixed also there with the air flowing through said heating cartridge 20. The porous burner 25 essentially comprises a combustion chamber or reactor 26, which is formed by one or several porous bodies with a plurality of passages or channels, for instance by at least one porous body made of ceramic material and to which is supplied a mixture of a gaseous energy carrier, for instance natural gas or propane gas, and air or another gas, such as oxygen-enriched air, configured to combust the gaseous energy carrier. The combustion of the gaseous energy carrier is effected in the interior of the porous body or reactor 26 with no flame formation on the outside surface of the porous body. The air and gaseous energy carrier may be conducted to the porous body 26 separately and then mixed therein, or may be mixed in a mixing area or chamber prior to entering the porous body 26.

Also possible in at least one of the embodiments according to the present application include, among other things: reduction in energy costs, reduction in the carbon dioxide load, and reduction in the heating-up time.

Through clean and equal-zero-emission combustion, exhaust gases from the porous burner 25 can be output directly at the place of installation into the shrink gas flow or also into a surrounding production hall without any further measures, such as, for example chimneys. Thus, for instance by operating the shrink gas heater 5 with natural gas or liquid gas, for instance propane gas, an energy cost saving of up to fifty percent can be achieved compared to an electronically operated shrink gas heater. The carbon dioxide discharge also, i.e. the carbon dioxide load is reduced with the gas-operated shrink gas heater 5 by about sixty percent compared to an electronically operated shrink gas heater 5 of the same output. The heater 5 can be installed and removed as one complete structural unit. In addition, it is also possible, with corresponding structural development, to install the heater 5 into already existing shrink tunnels 1, for instance for exchanging electric hot air or shrink gas heaters used to date. The present application has been described above by way of possible embodiments. It is obvious that numerous changes and variations are possible, in one possible embodiment also with regard to the embodiment of the shrink gas generator or shrink gas heater 5. However, common to the embodiments is that the burner or the heat source of the heater 5 is a flameless porous burner 25 where the gaseous energy carrier combusts without an open flame.

With a device for shrinking a shrink film onto packages or packaging units using a hot gaseous medium, for instance a gaseous medium essentially comprising hot air, said device having a hot gas heater that includes at least one gas burner for generating the hot, gaseous medium, the at least one burner is a porous burner.

One feature or aspect of an embodiment is believed at the time of the filing of this patent application to possibly reside broadly in a shrink tunnel for shrinking a shrink film 3 onto packages or packaging units 4 using a hot shrink gas, said shrink tunnel having a shrink gas heater 5 that includes at least one burner for generating the hot shrink gas, wherein the at least one burner is a porous burner 25.

Another feature or aspect of an embodiment is believed at the time of the filing of this patent application to possibly reside broadly in the shrink tunnel, comprising a shrink tunnel housing 12, through the interior space 6 of which the packaging units 4, wrapped with the shrink film 3, are moved on at least one conveyor 2, and by outlets 9, 11 for the hot shrink gas provided in the interior space 6.

Yet another feature or aspect of an embodiment is believed at the time of the filing of this patent application to possibly reside broadly in the shrink tunnel, wherein the at least one porous burner 25 is designed for operation with a gaseous fuel, for instance natural gas or liquid gas, e.g. propane gas.

Still another feature or aspect of an embodiment is believed at the time of the filing of this patent application to possibly reside broadly in the shrink tunnel, wherein the at least one porous burner 25 is designed for operation with a liquid fuel, for instance heating oil.

A further feature or aspect of an embodiment is believed at the time of the filing of this patent application to possibly reside broadly in the shrink tunnel, wherein the at least one burner 25 interacts with at least one porous body or reactor 6 forming the combustion space directly in the flow of the shrink gas or is positioned directly in the flow of the shrink gas.

Another feature or aspect of an embodiment is believed at the time of the filing of this patent application to possibly reside broadly in the shrink tunnel, wherein the shrink gas heater 5 and the at least one porous burner 25 form one complete structural unit which is installable and/or removable as such.

Yet another feature or aspect of an embodiment is believed at the time of the filing of this patent application to possibly reside broadly in a shrink gas heater for use with a shrink tunnel 1 for shrinking a shrink film 3 onto packages or packaging units 4 using a hot shrink gas, said shrink gas heater including at least one burner, wherein the at least one burner is a porous burner 25.

Still another feature or aspect of an embodiment is believed at the time of the filing of this patent application to possibly reside broadly in the shrink gas heater, wherein the at least one porous burner 25 is designed for operation with a gaseous fuel, for instance natural gas or liquid gas, e.g. propane gas.

A further feature or aspect of an embodiment is believed at the time of the filing of this patent application to possibly reside broadly in the shrink gas heater, wherein the at least one porous burner 25 is designed for operation with a liquid fuel, for instance heating oil.

Another feature or aspect of an embodiment is believed at the time of the filing of this patent application to possibly reside broadly in a method for shrinking a shrink film 3 onto packages or packaging units 4 using a hot shrink gas, said method including a shrink gas heater 5 that has at least one burner for generating the hot shrink gas, wherein a shrink tunnel according to the present application is used.

Yet another feature or aspect of an embodiment is believed at the time of the filing of this patent application to possibly reside broadly in a method for shrinking a shrink film 3 onto packages or packaging units 4 using a hot shrink gas, said method including a shrink gas heater 5 that includes at least one burner for generating the hot shrink gas, wherein a shrink gas heater according to the present application is used.

Still another feature or aspect of an embodiment is believed at the time of the filing of this patent application to possibly reside broadly in the method, wherein a gaseous or liquid hydrocarbon, in one possible embodiment natural gas or crude oil, is used as fuel for the porous burner.

Still yet another feature or aspect of an embodiment is believed at the time of the filing of this patent application to possibly reside broadly in a shrinkage tunnel for the shrinking of a shrink film onto packages or packing units making use of a hot shrink gas, with a shrink gas heater, which has at least one burner for producing the hot shrink gas, which acts directly on the flow of shrink gas or is arranged in it, characterized in that the at least one burner is a pore burner with a combustion space formed by at least one pore body or reactor.

Still yet another further feature or aspect of an embodiment is believed at the time of the filing of this patent application to possibly reside broadly in a shrinkage tunnel wherein the at least one pore burner with its pore body or reactor in a heating space is provided with a heating coffer or cartridge through which the shrink gas can flow, being somewhat spaced away from this, so that the hot combustion gases of the pore burner fed directly to the heating space heat the heating coffer or cartridge and are mixed in with the shrink gas flowing through this heating coffer or cartridge.

One feature or aspect of an embodiment is believed at the time of the filing of this patent application to possibly reside broadly in a shrink tunnel for the shrinking of a shrink wrap film onto packages, such as boxes, bottles, cans, or similar containers, or groups of packages, said shrink tunnel comprising: a housing being configured and disposed to enclose a heating space through which packages or groups of packages are to be transported; at least one conveyor being configured and disposed to transport packages or groups of packages thereon through said heating space; a heater comprising a porous combustion body being configured and disposed to combust a mixture of combustible gas and air therein to produce a hot exhaust gas; a conducting arrangement being configured and disposed to conduct combustible gas and air to be combusted into said porous combustion body; a blower arrangement being configured and disposed to conduct cold air to be heated past said heater, and to conduct a mixture of heated air and exhaust gas toward packages or groups of packages loosely wrapped in shrink wrap film to heat and shrink the shrink wrap film tightly around the packages or groups of packages; said porous combustion body being disposed within the flow path of cold air in said blower arrangement to directly mix hot exhaust gas with cold air flowing through said blower arrangement to form said mixture of heated air and exhaust gas; said porous combustion body having an area and volume sufficient to heat a sufficient volume of cold air to a temperature sufficient to shrink the shrink wrap material; said porous combustion body being configured to: maximize combustion of combustible gas to thereby minimize buildup of explosive, uncombusted combustible gas in said shrink tunnel; minimize heating-up time of said porous combustion body to thereby minimize energy costs related thereto; and promote even heating of air to thereby promote smooth, substantially wrinkle-free shrinking of shrink wrap film.

Another feature or aspect of an embodiment is believed at the time of the filing of this patent application to possibly reside broadly in the shrink tunnel, wherein: said shrink tunnel comprises a heating cartridge being disposed a distance from said porous combustion body and in the path of flow of cold air; said porous combustion body is configured to heat said heating cartridge; and said heating cartridge is configured and disposed to evenly heat said mixture of heated air and exhaust gas.

Yet another feature or aspect of an embodiment is believed at the time of the filing of this patent application to possibly reside broadly in the shrink tunnel, wherein: said tunnel housing comprises a plurality of outlets through which heated air is conducted into said heating space; and said heater comprises a complete structural unit being configured to be installed as a single unit.

Still another feature or aspect of an embodiment is believed at the time of the filing of this patent application to possibly reside broadly in a method of shrinking a shrink wrap film onto packages, such as boxes, bottles, cans, or similar containers, or groups of packages, in a shrink tunnel, said method comprising the steps of: transporting packages or groups of packages loosely wrapped in shrink wrap film on at least one conveyor through a heating space in said shrink tunnel; conducting combustible gas and air to be combusted into a porous combustion body of a heater; combusting a mixture of combustible gas and air within said porous combustion body; conducting with a blower arrangement cold air to be heated past said porous combustion body which is disposed in the flow path of the cold air; mixing and heating said cold air with exhaust gas; and conducting with said blower arrangement a mixture of heated air and exhaust gas toward the packages or groups of packages loosely wrapped in shrink wrap film to heat and shrink the shrink wrap film tightly around the packages or groups of packages.

A further feature or aspect of an embodiment is believed at the time of the filing of this patent application to possibly reside broadly in the method, wherein said method further comprises: heating a heating cartridge disposed a distance from said porous combustion body with said mixture of heated air and exhaust gas; conducting said mixture of heated air and exhaust gas past said heating cartridge to evenly heat said mixture of heated air and exhaust gas; and conducting said mixture of heated air and exhaust gas through a plurality of outlets in said shrink tunnel.

Another feature or aspect of an embodiment is believed at the time of the filing of this patent application to possibly reside broadly in the method, wherein said step of combusting a mixture of combustible fuel and air comprises combusting fuel comprising a gaseous fuel or a liquid fuel.

Yet another feature or aspect of an embodiment is believed at the time of the filing of this patent application to possibly reside broadly in the shrink tunnel for the shrinking of a shrink wrap film onto packages, such as boxes, bottles, cans, or similar containers, or groups of packages, said shrink tunnel comprising: a heater comprising a porous combustion body being configured and disposed to combust a mixture of combustible fuel and a gas configured to combust said combustible fuel therein to form a hot exhaust gas; an air-moving arrangement being configured and disposed to conduct ambient air to be mixed with said exhaust gas to form a heated gas configured to heat and shrink the shrink wrap film around the packages or groups of packages; and said air-moving arrangement being configured and disposed to conduct the heated gas toward packages or groups of packages loosely wrapped in shrink wrap film to heat and shrink the shrink wrap film around the packages or groups of packages.

Still another feature or aspect of an embodiment is believed at the time of the filing of this patent application to possibly reside broadly in the shrink tunnel, wherein: said shrink tunnel comprises a heating cartridge being disposed a distance from said porous combustion body and in the path of flow of air; and said porous combustion body is configured to heat said heating cartridge.

A further feature or aspect of an embodiment is believed at the time of the filing of this patent application to possibly reside broadly in the shrink tunnel, wherein: said shrink tunnel comprises a tunnel housing configured and disposed to enclose a heating space through which packages or groups of packages are to be transported; and said tunnel housing comprises a plurality of outlets through which heated air is conducted into said heating space.

Another feature or aspect of an embodiment is believed at the time of the filing of this patent application to possibly reside broadly in the shrink tunnel, wherein: said porous combustion body is configured to combust one of gaseous fuel or liquid fuel; and said heater comprises a complete structural unit being configured to be installed as a single unit.

Yet another feature or aspect of an embodiment is believed at the time of the filing of this patent application to possibly reside broadly in the shrink tunnel, wherein said porous combustion body is configured to combust gaseous fuel comprising natural gas or propane gas.

Still another feature or aspect of an embodiment is believed at the time of the filing of this patent application to possibly reside broadly in the shrink tunnel, wherein said porous combustion body is configured to combust liquid fuel comprising heating oil.

A further feature or aspect of an embodiment is believed at the time of the filing of this patent application to possibly reside broadly in a method of shrinking a shrink wrap film onto packages, such as boxes, bottles, cans, or similar containers, or groups of packages, in a shrink tunnel, said method comprising the steps of: transporting packages or groups of packages loosely wrapped in shrink wrap film in said shrink tunnel; combusting a mixture of combustible fuel and air within a porous combustion body of a heater and thus forming a hot exhaust gas; conducting ambient air to be heated past said porous combustion body which is disposed at least partially in the flow path of the air and mixing said ambient air and said exhaust gas; and heating the air and conducting the mixture of heated air and exhaust gas toward the packages or groups of packages loosely wrapped in shrink wrap film and heating and shrinking the shrink wrap film around the packages or groups of packages.

Another feature or aspect of an embodiment is believed at the time of the filing of this patent application to possibly reside broadly in the method, wherein said method further comprises: heating a heating cartridge disposed a distance from said porous combustion body with said mixture of heated air and exhaust gas; and conducting air past said heating cartridge.

Yet another feature or aspect of an embodiment is believed at the time of the filing of this patent application to possibly reside broadly in the method, wherein said method further comprises conducting said mixture of heated air and exhaust gas through a plurality of outlets in said shrink tunnel.

Still another feature or aspect of an embodiment is believed at the time of the filing of this patent application to possibly reside broadly in the method, wherein said step of combusting a mixture of combustible fuel and air comprises combusting fuel comprising a gaseous fuel or a liquid fuel.

A further feature or aspect of an embodiment is believed at the time of the filing of this patent application to possibly reside broadly in a method of shrinking a shrink wrap film onto packages, such as boxes, bottles, cans, or similar containers, or groups of packages, in a shrink tunnel, said method comprising the steps of: transporting packages or groups of packages loosely wrapped in shrink wrap film in said shrink tunnel; combusting a mixture of combustible fuel and a gas configured to combust said combustible fuel within a porous combustion body of a heater and thus forming a hot exhaust gas from said heater; mixing ambient air and said exhaust gas and forming a heated gas mixture configured to shrink said shrink wrap film; and conducting the heated gas mixture toward the packages or groups of packages loosely wrapped in shrink wrap film and heating and shrinking the shrink wrap film around the packages or groups of packages with the heated gas mixture.

Another feature or aspect of an embodiment is believed at the time of the filing of this patent application to possibly reside broadly in the method, wherein said step of mixing ambient air and said exhaust gas comprises conducting ambient air past said porous combustion body which is disposed at least partially in a flow path of the ambient air.

Yet another feature or aspect of an embodiment is believed at the time of the filing of this patent application to possibly reside broadly in the method, wherein said method further comprises: heating a heating arrangement disposed a distance from said porous combustion body with said mixture of heated air and exhaust gas; and conducting said mixture of heated air and exhaust gas past said heating arrangement.

Still another feature or aspect of an embodiment is believed at the time of the filing of this patent application to possibly reside broadly in the method, wherein: said method further comprises conducting said mixture of heated air and exhaust gas through a plurality of outlets in said shrink tunnel; and said gas configured to combust said combustible fuel comprises air.

A further feature or aspect of an embodiment is believed at the time of the filing of this patent application to possibly reside broadly in the method, wherein: said step of combusting a mixture of combustible fuel and air comprises combusting fuel comprising a gaseous fuel or a liquid fuel; and said porous combustion body having an area and volume sufficient to heat a sufficient volume of cold air to a temperature sufficient to shrink the shrink wrap material.

Another feature or aspect of an embodiment is believed at the time of the filing of this patent application to possibly reside broadly in the method, wherein said gaseous fuel comprises natural gas or propane gas.

Yet another feature or aspect of an embodiment is believed at the time of the filing of this patent application to possibly reside broadly in the method, wherein said liquid fuel comprises heating oil.

Still another feature or aspect of an embodiment is believed at the time of the filing of this patent application to possibly reside broadly in the method, wherein said method further comprises: heating a heating cartridge disposed a distance from said porous combustion body with said mixture of heated air and exhaust gas; and conducting said mixture of heated air and exhaust gas past said heating cartridge.

A further feature or aspect of an embodiment is believed at the time of the filing of this patent application to possibly reside broadly in the method, wherein: said method further comprises conducting said mixture of heated air and exhaust gas through a plurality of outlets in said shrink tunnel; and said gas configured to combust said combustible fuel comprises air.

Another feature or aspect of an embodiment is believed at the time of the filing of this patent application to possibly reside broadly in the method, wherein: said step of combusting a mixture of combustible fuel and air comprises combusting fuel comprising a gaseous fuel or a liquid fuel; and said porous combustion body having an area and volume sufficient to heat a sufficient volume of cold air to a temperature sufficient to shrink the shrink wrap material.

Yet another feature or aspect of an embodiment is believed at the time of the filing of this patent application to possibly reside broadly in the method, wherein said method further comprises mixing combustible fuel and gas configured to combust said combustible fuel and then conducting the mixture into said porous combustion body for combustion therein.

Still another feature or aspect of an embodiment is believed at the time of the filing of this patent application to possibly reside broadly in the method, wherein said method further comprises conducting combustible fuel and gas configured to combust said combustible fuel separately into said porous combustion body and then mixing and combusting the combustible fuel and gas configured to combust said combustible fuel therein.

The components disclosed in the various publications, disclosed or incorporated by reference herein, may possibly be used in possible embodiments of the present invention, as well as equivalents thereof.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

The appended drawings in their entirety, including all dimensions, proportions and/or shapes in at least one embodiment of the invention, are accurate and are hereby included by reference into this specification.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

All, or substantially all, of the components and methods of the various embodiments may be used with at least one embodiment or all of the embodiments, if more than one embodiment is described herein.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

All of the patents, patent applications and publications recited herein, and in the Declaration attached hereto, are hereby incorporated by reference as if set forth in their entirety herein.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

Some examples of porous burners or heaters and components thereof which may possibly used or adapted for use in at least one possible embodiment may possibly be found in the following publications: F. Durst, A. Kesting, S. Mößbauer, K. Pickenäcker, O. Pickenäcker, D. Timis, "Der Porenbrenner-Konzept, Technik and Anwendungsgebiete," GASWÄRME International, Vol. 46, Heft 6, 1997; A J. Barra, G. Diepvensa, J. L. Ellzey, Michael R. Henneke, "Numerical study of the effects of material properties on flame stabilization in a porous burner," Combustion and Flame 134, 369-379, 2003; X. Y. Zhou, J. C. F. Pereira, "Numerical Study of Combustion and Pollutants Formation in Inert Nonhomogeneous Porous Media," Combust. Sci. and Tech., Vol. 130, pp. 335-364, 1997; W. Mathis, J. L. Ellzey, Flame Stabilization, "Operating Range, and Emissions for a Methane/Air Porous Burner," Combust. Sci. and Tech., 175: 825-839, 2003; M. T. Smucker, J. L. Ellzey, "Computational and experimental Study of a Two-Section Porous Burner," Combust. Sci. and Tech., 176: 1171-1189, 2004; N. Djordjevic, P. Habisreuther and N. Zarzalis, (2008), "Flame stabilization and emissions of a natural gas/air ceramic porous burner", Advanced Materials Research, 47-50, 105-108; P. Habisreuther, N. Djordjevic and N. Zarzalis, (2008), "Numerische Simulation der Mikroströömung in poröösen inerten Strukturen", Chemie Ingenieur Technik, 80, 327-341; N. Djordjevic, P. Habisreuther, N. Zarzalis, (2009), "Application of porous, ceramic, sponge-like structures in premixed combustion technology", Materials and Manufacturing Processes; N. Djordjevic, P. Habisreuther, N. Zarzalis, (2009), "Experimental study on the influence of the pore size of SiSiC sponge on the flame stabilization in a porous burner", in Proc. 4th European Combustion Meeting, Vienna, Austria; N. Djordjevic, P. Habisreuther, N. Zarzalis, "Poster: Experimental study on the influence of the pore size of SiSiC sponge on the flame stabilization in a porous burner", European Combustion Meeting, Vienna, 2009; N. Djordjevic, P. Habisreuther, N. Zarzalis, (2009), "Numerical simulation of the combustion in solid sponges: Relative importance of the different transport mechanisms for the flame stabilization", in Sixth Mediterranean Combustion Symposium, Corsica, France, June 7-11; Habisreuther P., Djordjevic, N. and Zarzalis N., (2009), "Statistical Distribution of Residence Time and Tortuosity of Flow through Open-Cell Foams", Chemical Engineering Science.

All of the patents, patent applications or patent publications, which were cited in the German Office Action dated Jul. 11, 2007, and/or cited elsewhere are hereby incorporated by reference as if set forth in their entirety herein as follows: DE 20 15 893, having the following English translation of the German title "SHRINK TUNNEL," published on Oct. 22, 1970; and DE 22 16 822, having the following English translation of the German title "METHOD AND APPARATUS FOR SHRINKING PLASTIC FILM OVER GROUPED ARTICLES," published on Oct. 19, 1972.

All of the patents, patent applications or patent publications, which were cited in the International Search Report dated Dec. 4, 2007, and/or cited elsewhere are hereby incorporated by reference as if set forth in their entirety herein as follows: EP 1,247,745, having the title "An oven for shrinking heat-shrinkable film packaging," published on Oct. 9, 2002; U.S. Pat. No. 3,717,939, having the title "SHRINK FILM OVEN," published on Feb. 27, 1973; U.S. Pat. No. 4,746,287, having the title "FIBER MATRIX BURNER COMPOSITION WITH ALUMINUM ALLOYS AND METHOD OF FORMULATION," published on May 24, 1988; DE 196 46 957, having the following English translation of the German title "METHOD AND DEVICE FOR THE COMBUSTION OF LIQUID FUEL," published on May 14, 1998; and WO 02/36436, having the title "ADAPTABLE PACKAGING MACHINE HEAT SHRINK TUNNEL," published on May 10, 2002.

One type of porous burner or heater and components thereof is sold by Thermo-Stone USA, 791 Neeson Road, Marina, CA 93933.

Some examples of porous burners or heaters which may possibly be used in at least one possible embodiment of the present application may possibly be found in the following U.S. Pat. No. 5,073,625, entitled "Self-regulating porous heating device"; U.S. Pat. No. 4,794,226, entitled "Self-regulating porous heater device"; and U.S. Pat. No. 6,859,617, entitled "Porous thin film heater and method".

One type of shrink tunnel is the Innopack Kisters ST line of shrink tunnels manufactured by KHS AG, Juchostrasse 20, 44143 Dortmund, Federal Republic of Germany. These shrink tunnels operate using gas instead of an electric heater, which can reduce packing machine energy costs and carbon emissions. These shrink tunnels have a comparatively short heat-up phase so these machines take less time to start running, which results in increased efficiency of the machine and the whole packaging lines related thereto. In addition, temperatures of these shrink tunnels can be set with relative or substantial precision, which promotes even heating and minimization of wrinkles in the shrink-wrapping. Two such shrink tunnel models are the Innopack Kisters ST 700 and 1000 series.

Some other examples of shrink tunnels and components thereof which may possibly be utilized or adapted for use in at least one possible embodiment may possibly be found in the following U.S. Pat. No. 7,363,728, issued Apr. 29, 2008, entitled "Shrink Wrap Tunnel with Variable Set Points;" U.S. Pat. No. 5,746,041, issued May 5, 1998, entitled "Shrinking Selected Portions of Film Wrapped Around a Product;" U.S. Pat. No. 5,740,659, issued Apr. 21, 1998, entitled "Shrink Tunnel and Methods Relating Thereto;" and U.S. Pat. No. 5,546,677, issued Aug. 20, 1996, entitled "Apparatus and Method for Shrinking Film Wrapped Around a Product."

The patents, patent applications, and patent publication listed above in the preceding seven paragraphs are herein incorporated by reference as if set forth in their entirety. The purpose of incorporating U.S. patents, Foreign patents, publications, etc. is solely to provide additional information relating to technical features of one or more embodiments, which information may not be completely disclosed in the wording in the pages of this application. Words relating to the opinions and judgments of the author and not directly relating to the technical details of the description of the embodiments therein are not incorporated by reference. The words all, always, absolutely, consistently, preferably, guarantee, particularly, constantly, ensure, necessarily, immediately, endlessly, avoid, exactly, continually, expediently, ideal, need, must, only, perpetual, precise, perfect, require, requisite, simultaneous, total, unavoidable, and unnecessary, or words substantially equivalent to the above-mentioned words in this sentence, when not used to describe technical features of one or more embodiments, are not considered to be incorporated by reference herein.

The corresponding foreign and international patent publication applications, namely, Federal Republic of Germany Patent Application No. 10 2007 015 753.5, filed on Mar. 30, 2007, having inventor Thomas LELIE, and DE-OS 10 2007 015 753.5 and DE-PS 10 2007 015 753.5, and International Application No. PCT/EP2007/003987, filed on May 7, 2007, having WIPO Publication No. WO 2008/119369 and inventor Thomas LELIE, are hereby incorporated by reference as if set forth in their entirety herein for the purpose of correcting and explaining any possible misinterpretations of the English translation thereof. In addition, the published equivalents of the above corresponding foreign and international patent publication applications, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

The purpose of incorporating the corresponding foreign equivalent patent application(s), that is, PCT/EP2007/003987 and German Patent Application 10 2007 015 753.5, is solely for the purpose of providing a basis of correction of any wording in the pages of the present application, which may have been mistranslated or misinterpreted by the translator. Words relating to opinions and judgments of the author and not directly relating to the technical details of the description of the embodiments therein are not to be incorporated by reference. The words all, always, absolutely, consistently, preferably, guarantee, particularly, constantly, ensure, necessarily, immediately, endlessly, avoid, exactly, continually, expediently, ideal, need, must, only, perpetual, precise, perfect, require, requisite, simultaneous, total, unavoidable, and unnecessary, or words substantially equivalent to the above-mentioned word in this sentence, when not used to describe technical features of one or more embodiments, are not generally considered to be incorporated by reference herein.

Statements made in the original foreign patent applications PCT/EP2007/003987 and DE 10 2007 015 753.5 from which this patent application claims priority which do not have to do with the correction of the translation in this patent application are not to be included in this patent application in the incorporation by reference.

Any statements about admissions of prior art in the original foreign patent applications PCT/EP2007/003987 and DE 10 2007 015 753.5 are not to be included in this patent application in the incorporation by reference, since the laws relating to prior art in non-U.S. Patent Offices and courts may be substantially different from the Patent Laws of the United States.

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

The details in the patents, patent applications and publications may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. § 1.72(b). As stated in 37 C.F.R. § 1.72(b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

AT LEAST PARTIAL NOMENCLATURE

1 Shrink tunnel
2 Conveyor
3 Shrink film
4 Packaging unit
5 Shrink gas heater
6 Interior space
7 Electric motor
8 Blower
9 Outlet
10 Blower
11 Outlet
12 Shrink tunnel housing
13 Housing
14 Flow path
14.1, 14.2 Section
15 Flow path
15.1, 15.2 Section
16, 17 Outlet
18 Inlet
19 Heating spacer
20 Heating cartridge
22 Partition walls
23, 24 Air guide
25 Porous burner
26 Reactor
A, B, C Flow

What is claimed is:

1. A shrink-wrapping arrangement comprising:

a tunnel configured to receive packages or packaging units wrapped in shrink film;

a housing disposed at an upper wall portion of said tunnel;

a combustion heater being mounted at an upper portion of said housing, said combustion heater having a porous burner configured to burn a fuel mixture in a combustion space therein to generate combustion gases without generating an open flame outside of said porous burner;

an inflow duct connecting said tunnel to said housing, said inflow duct being formed with an inflow opening;

at least one outflow duct connecting said housing to said tunnel;

said combustion heater being disposed above at least a portion of said inflow opening;

said combustion heater being configured to direct combustion gases generally downwardly into said housing to mix with inflowing, recycled, shrink gas entering said housing from said at least one inflow duct, which combustion gases have a higher temperature than the inflowing, recycled, shrink gas; and gas flow guide structures disposed within said housing and configured to control a mixing ratio between the inflowing, recycled, shrink gas bypassing a partitioned heating space and the combustion gases emanating from said combustion space entering said heating space, and thus to generate an outflowing shrink gas having a desired temperature prior to the outflowing shrink gas entering said at least one outflow duct, which desired temperature is higher than the temperature of the inflowing, recycled, shrink gas and also is sufficient to heat and shrink the shrink film onto a package; and gas channels inside said tunnel, said gas channels communicating with said at least one outflow duct and being formed for distributing the outflowing shrink gas into a flow of top air that is guided towards the package substantially from the side and a separate flow of bottom air that is guided towards the package substantially from below.

2. The shrink-wrapping arrangement according to claim 1, wherein said guide structures are disposed adjacent but spaced apart from said porous burner, and to be in the path of the inflowing, recycled, shrink gas and the combustion gases.

3. The shrink-wrapping arrangement according to claim 2, wherein said shrink-wrapping arrangement comprises at least one conveyor configured to convey packages or packaging units through said tunnel.

4. The shrink-wrapping arrangement according to claim 3, wherein said porous burner is configured to utilize at least one of: gaseous fuel, gaseous hydrocarbon fuel, natural gas, liquid gas, and propane gas.

5. The shrink-wrapping arrangement according to claim 3, wherein said porous burner is configured to utilize liquid fuels or heating oil.

6. The shrink-wrapping arrangement according to claim 3, wherein said porous burner comprises a ceramic material.

7. The shrink-wrapping arrangement according to claim 3, wherein said inflow opening is disposed in a side wall of said housing.

8. The shrink-wrapping arrangement according to claim 7, wherein said gas flow guide structures are disposed below said heater in their entirety.

* * * * *